US005452686A

United States Patent [19]

Stahl

[11] Patent Number: 5,452,686

[45] Date of Patent: Sep. 26, 1995

[54] WASTE HEAT BOILER

[75] Inventor: Henrik O. Stahl, Rungsted Kyst, Denmark

[73] Assignee: Haldor Topsoe A/S, Denmark

[21] Appl. No.: 216,699

[22] Filed: Mar. 23, 1994

[30] Foreign Application Priority Data

Mar. 26, 1993 [DK] Denmark ..... 0357/93

[51] Int. Cl.[6] ..... F23G 3/00

[52] U.S. Cl. ..... 122/135.1; 165/101; 122/235.17; 122/20 B; 122/7 R

[58] Field of Search ..... 110/234, 233; 122/7 R, 20 B, 135.1, 235.17; 165/101

[56] References Cited

U.S. PATENT DOCUMENTS

| | | | |
|---|---|---|---|
| 2,990,161 | 6/1961 | Blaskowski | 165/101 |
| 3,477,411 | 11/1969 | Gething | 122/135 R |
| 4,483,258 | 11/1984 | John et al. | 122/235 |
| 4,612,879 | 9/1986 | Cooke | 122/135.1 |
| 4,738,309 | 4/1988 | Schilling | 165/101 |
| 4,766,883 | 8/1988 | Cameron et al. | 122/20 B |
| 4,887,464 | 12/1989 | Nehrbauer | 165/101 |
| 4,899,696 | 2/1990 | Kennedy et al. | 122/135.1 |
| 4,993,367 | 2/1991 | Kehrer | 165/101 |
| 5,040,470 | 8/1991 | Lofton et al. | 122/135.1 |
| 5,085,037 | 2/1992 | Scott | 165/101 |
| 5,215,018 | 6/1993 | Sandari et al. | 110/235 |

FOREIGN PATENT DOCUMENTS

| | | |
|---|---|---|
| 0357907 | 7/1989 | European Pat. Off. . |
| 3017411 | 11/1981 | Germany . |
| 7216834 | 6/1974 | Netherlands . |
| 425559 | 4/1935 | United Kingdom . |

*Primary Examiner*—Marguerite Macy
*Attorney, Agent, or Firm*—Ostrolenk, Faber, Gerb & Soffen

[57] ABSTRACT

Waste heat boiler comprising within a cylindrical shell a plurality of heat exchanging tubes having an inlet end and outlet end;

attached to the shell, means for introducing water on shellside of the tubes;

means for introducing a hot process stream into the inlet end of the tubes and passing the gas stream through the tubes in indirect heat exchange with the water on the shellside of the tubes to produce water/steam and to cool the introduced process stream;

means for withdrawing produced water/steam, and means for withdrawing the cooled gas stream;

wherein the tubes are arranged in at least two tube bundles each of which is provided with means for adjusting flow distribution and flow rate of the hot gas stream between the tube bundles to control the production of steam and the cooling of the process stream.

7 Claims, 1 Drawing Sheet

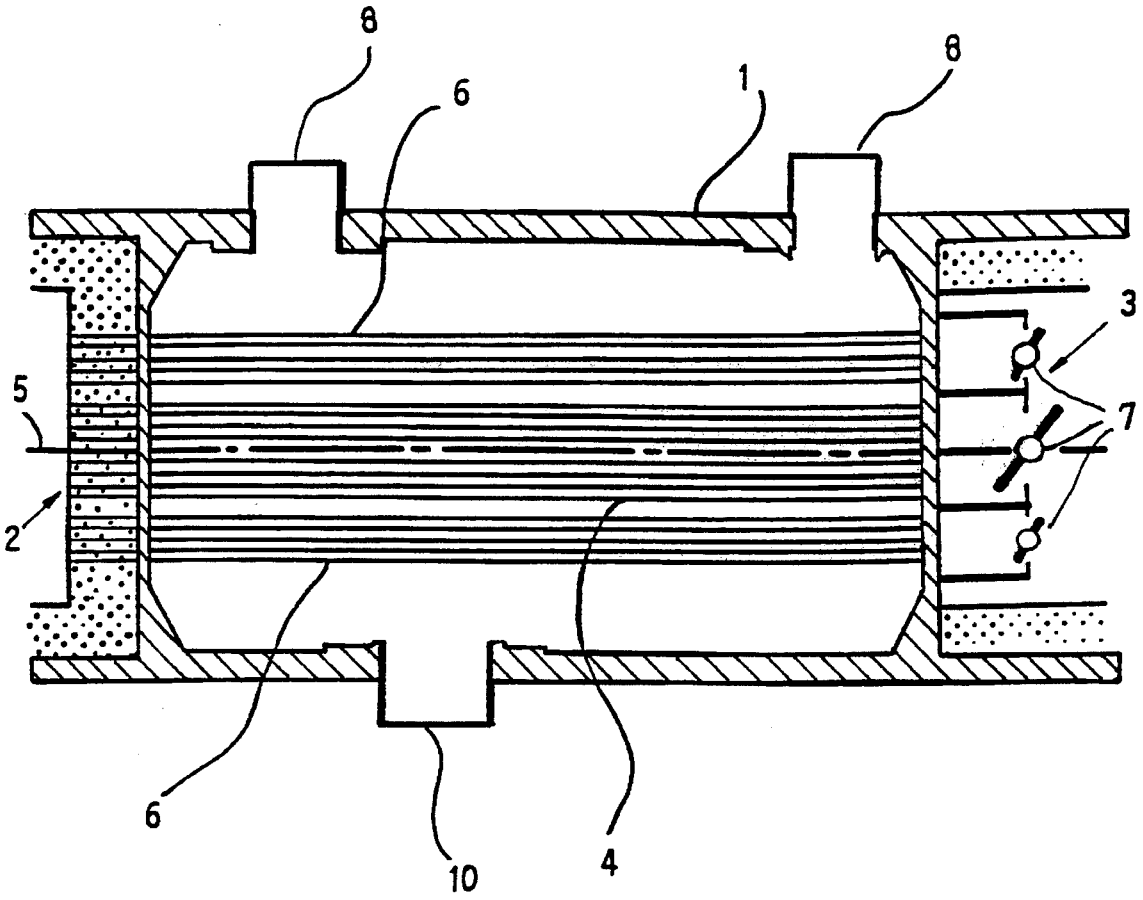
8
6
1
8
3
5
7
2
6
10
4

WASTE HEAT BOILER

BACKGROUND OF THE INVENTION

The present invention is directed to the recovery of waste heat from chemical reactions. More particularly, the invention relates to a waste heat boiler with improved control of cooling effect.

Waste heat boilers are most generally used for the generation of steam by waste heat recovered from hot process streams. Typically, those boilers are designed as shell-and-tube exchangers with a plurality of heat exchanging tubes arranged within a cylindrical shell.

Two basic types of shell-and-tube exchangers are employed in the industry, the watertube type, in which water/steam mixtures flow through the tubes, and the fire tube type having the heating process stream inside the tubes.

The characteristic components of the boiler are the tubes mounted in tubesheets at a front-end head and a rear-end head within the shell. In the firetube boilers steam production is accomplished on the shell side of the tubes by indirect heat exchange of a hot process stream flowing through the boiler tubes. The shell side is through a number of risers and downcomers connected to a steam drum, which may be arranged at the top of the boiler shell.

The mechanical design and, in particular, dimensioning of the heat exchanging surface in shell-and-tube exchanger type boilers represent certain problems. Boiler applications involve high pressures on the shell side and considerable temperature differences between the shell-and-tube side. Particular considerations have to be given to fouling and corrosion characteristics of the process stream.

Boilers handling fouling or corrosion prove process streams must be designed to a higher duty than required in order to allow for satisfying lifetime under serious fouling and corroding conditions. The heat transferring surface of the boiler tubes has further to be adapted to expected corrosion and fouling factors in the stream. To provide for a desired and substantially constant cooling effect during long term operation of the boilers, appropriate heat transfer and temperature control is required.

Conventionally designed boilers are equipped with a by-pass of a large diameter tube, which may be internal or external to the boiler shell. The by-pass is usually construed as an insulated tube provided with a flow control valve. During initial operation of the boilers, part of the hot process stream is by-passed the heat transferring tubes to limit the heat transfer within the required level.

After a certain time on stream fouling and corrosion of the tubes increase, leading to decreased heat transfer. The amount of by-passed process stream is then reduced, which allows for higher flow of the process stream through the heat transferring tubes to maintain the required cooling effect.

A major drawback of the known boilers of the above type is vigorous corrosion on the metallic surface of the by-pass and flow control valve, which are in contact with the uncooled process stream at temperatures as high as 1000° C.

SUMMARY OF THE INVENTION

The main object of this invention is to avoid the above drawback of the known waste heat boilers that is to provide a boiler of the shell-and-tube exchanger type with an improved heat transfer and temperature control.

Accordingly, a broad embodiment of the invention is directed towards a waste heat boiler comprising within a cylindrical shell a plurality of heat exchanging tubes having an inlet end and outlet end;

attached to the shell, means for introducing water on shellside of the tubes;

means for introducing a hot process stream into the inlet end of the tubes and passing the process stream through the tubes in indirect heat exchange with the water on the shellside of the tubes to produce steam and to cool the introduced process stream;

means for withdrawing produced steam, and means for withdrawing the cooled gas stream;

wherein the tubes are arranged in at least two tube bundles each of which is provided with means (7) for adjusting flow distribution and flow rate of the hot gas stream between the tube bundles to control the production of steam and the cooling of the process stream.

In the inventive boiler design, heat transfer control is performed by distribution of the hot process stream between the different tube bundles. At a reduced flow of the hot process stream through the tubes in one tube bundle, the flow velocity through the tubes in the other bundle increases correspondingly at constant flow of the hot process stream through the boiler. Increase in mass velocity of the process stream is accompanied by an increase of heat transfer. Thus, by proper adjustment of the flow of the hot process stream in the different tube bundles, it is possible to control the heat transfer and temperature in the process stream and steam leaving the boiler at changing fouling conditions.

Flow distribution control of the incoming process stream between the bundles and through the tubes may be accomplished by means of a control valve in an outlet chamber arranged adjacent to the bundles at the outlet side of the tubes.

Contrary to conventional boilers with an insulated by-pass tube, severe corrosion of metallic surfaces in the tubes and valves through contact with the uncooled process stream at high temperatures is avoided. The metallic surface of the tubes and valves (7) in the boiler according to the invention are exposed to a cooled process stream at lower temperatures through heat exchange with water/steam on shell side of the tubes.

In a preferred embodiment of the invention, the tube bundles of the boiler are, furthermore, equipped with different numbers of tubes, which allow both control of velocity and heat exchanging area and thus a more close control of the temperature in the boiler.

As an alternative or in addition to the above embodiment, the tube bundles may be further provided with tubes having different diameters in different bundles.

Temperature control is, thereby, performed by distributing the hot process stream in different amounts to bundles of different tube diameters, whereby the smaller diameter tubes yield higher heat transfer coefficients, and, thus, more efficient cooling of the process stream at increasing flow through the smaller diameter tubes.

When distributing the hot process stream in different amounts to the bundles and through the heat exchanging tubes, it is possible to adapt heat transfer to changes in fouling and load of the boiler without exposing the metallic surfaces of the tubes and valves in the boiler to high temperatures, which cause severe corrosion in the boiler.

The above features and advantages of the invention will become further apparent from the following detailed description of a specific embodiment thereof.

BRIEF DESCRIPTION OF THE DRAWING

The attached drawing is a cross-sectional view of a preferred embodiment of the invention.

DETAILED DESCRIPTION OF THE PREFERRED EMBODIMENT

In the attached drawing, the main section of a waste heat boiler according to the present invention is shown. The boiler comprises a cylindrical shell or body 1 having thereon means 10 (commonly referred to as a "downcomer") for introducing water into the boiler on the shell side of the heat exchanging tubes located in the boiler, and means 8 (commonly referred to as "risers") for withdrawing steam produced in the boiler. Heat exchanging tube bundles 4 and 6 are mounted in the boiler between the inlet end 2 and outlet end 3 of the boiler. By reference to the center line 5 of the boiler, it is seen that tube bundle 4 is substantially centrally mounted within the boiler. Tube bundle 6 is concentrically mounted around tube bundle 4. Each of the tube bundles is provided with control means 7 for adjusting flow distribution and flow rate of the hot gas stream between the tube bundles. The flow of the hot gas stream within the tubes is from the inlet end 2 through the tubes to the outlet end 3, with the control means 7 mounted on the outlet end 3. In the drawing, control means 7 are shown as control valves.

In a computing model, a waste heat boiler of the shell-and-tube exchanger type according to the invention, provided with two tube bundles provided with tubes having different diameter in each bundle and a flow control system in form of control valve in an outlet chamber at the outlet end of the tubes is operated on 449,782 $Nm^3/h$ reformed gas with an inlet temperature of 950° C. The boiler is equipped within a cylindrical shell with a first tube bundle (4) of 150 tubes having an external diameter of 3 inches and a length of 5.5 m arranged around the axis of the shell and a second bundle (6) containing 450 tubes with an external diameter of 2 inches and a length of 5.5 m mounted concentric around the first bundle.

The outlet temperature of the cooled process stream from each tube bundle and in the mixed cooled process stream at different flow distribution to the two bundles is shown for different fouling factors of 0 and $6 \cdot 10^{-4}$ in Table 1 and Table 2, respectively.

TABLE 1

| Fouling | | 0.0000 | | | | | | | | |
|---|---|---|---|---|---|---|---|---|---|---|
| 450 tubes 2" 5,5 m | Flow | 100% | 90% | 80% | 70% | 50% | 30% | 20% | 10% | 0% |
| | $t_{out}$ | 487 | 481 | 474 | 466 | 448 | 423 | 405 | 379 | |
| 150 tubes 3" 5,5 m | Flow | 0% | 10% | 20% | 30% | 50% | 70% | 80% | 90% | 100% |
| | $t_{out}$ | | 476 | 516 | 541 | 573 | 595 | 605 | 613 | 620 |
| Mixed gas | | 487 | 480 | 482 | 488 | 510 | 543 | 565 | 590 | 620 |

TABLE 1

| Fouling | | 0.0006 | | | | | | | | |
|---|---|---|---|---|---|---|---|---|---|---|
| 450 tubes 2" 5,5 m | Flow | 100% | 90% | 80% | 70% | 50% | 30% | 20% | 10% | 0% |
| | $t_{out}$ | 556 | 545 | 532 | 519 | 488 | 448 | 422 | 387 | |
| 150 tubes 3" 5,5 m | Flow | 0% | 10% | 20% | 30% | 50% | 70% | 80% | 90% | 100% |
| | $t_{out}$ | | 491 | 542 | 576 | 622 | 655 | 668 | 680 | 691 |
| Mixed gas | | 556 | 540 | 534 | 536 | 555 | 592 | 619 | 651 | 691 |

As apparent from the Tables, the temperature in the cooled process stream is controlled by different distribution of the hot inlet stream to the first and second tube bundle. As an example, at a required outlet temperature of 590° C. in the cooled process stream, 10% of the hot stream is passed through the smaller diameter tubes and the residue through the larger diameter tubes at unfouled condition in the boiler. At changed fouling condition, i.e. a fouling factor of $6 \cdot 10^{-4}$, the flow through the smaller diameter tubes must be increased to 30% in order to obtain the required outlet temperature of 590° C.

Temperature control is, thereby, obtained without exposing metallic surfaces of the boiler to high temperatures, where severe corrosion occurs.

In the attached drawing, the main section of a waste heat boiler according to the present invention is shown. The boiler comprises a cylindrical shell or body 1 having thereon means 10 (commonly referred to as a "downcomer") for introducing water into the boiler on the shell side of the heat exchanging tubes located in the boiler, and means 8 (commonly referred to as "risers") for withdrawing steam produced in the boiler. Heat exchanging tube bundles 4 and 6 are mounted in the boiler between the inlet end 2 and outlet end 3 of the boiler. By reference to the center line 5 of the boiler, it is seen that tube bundle 4 is substantially centrally mounted within the boiler. Tube bundle 6 is concentrically mounted around tube bundle 4. Each of the tube bundles is provided with control means 7 for adjusting flow distribution and flow rate of the hot gas stream between the tube bundles. The flow of the hot gas stream within the tubes is from the inlet end 2 through the tubes to the outlet end 3, with the control means 7 mounted on the outlet end 3. In the drawing, control means 7 are shown as control valves.

I claim:

1. A waste heat boiler comprising:

a generally cylindrical shell;

a plurality of heat exchanging tube disposed within said shell, each of said tube bundles having an inlet end and an outlet end;

means for introducing water into said shell on shellside of said tubes;

means for introducing a hot process stream into the inlet end of said tubes in heat exchanging relationship with the water on the shellside of said tubes to cool said stream and to heat the water to produce heated water and/or steam;

means for withdrawing said produced heated water and/or steam; and means for withdrawing said cooled process stream;

wherein said plurality of tubes are provided in the form of two or more concentric tube bundles, each of said concentric tube bundles being provided with means for adjusting flow rate and flow distribution of the hot process stream between said bundles.

2. Waste heat boiler according to claim 1, wherein the means for adjusting flow distribution of the hot gas stream consists of a control valve in an outlet chamber mounted on each tube bundle at the outlet ends of the tubes in the bundle.

3. Waste heat boiler according to claim 1, wherein the tube bundles contain different number of tubes.

4. Waste heat boiler according to claim 1, wherein the tubes in the different bundles have a different diameter.

5. Waste heat boiler according to claim 1, wherein the tube bundles are provided with a different number of tubes having different diameters in the different bundles.

6. Waste heat boiler according to claim 2, wherein the tube bundles contain different number of tubes.

7. Waste heat boiler according to claim 2, wherein the tubes in the different bundles have a different diameter.

* * * * *